United States Patent [19]

Kajita et al.

[11] Patent Number: 4,566,780

[45] Date of Patent: Jan. 28, 1986

[54] SHELL-TYPE ELECTROSTATIC COPYING APPARATUS

[75] Inventors: Hiroshi Kajita, Kobe; Tadanobu Nakajima, Sakurai, both of Japan

[73] Assignee: Mita Industrial Co., Ltd., Japan

[21] Appl. No.: 577,916

[22] Filed: Feb. 7, 1984

[30] Foreign Application Priority Data

Feb. 21, 1983 [JP] Japan ..... 58-26283

[51] Int. Cl.[4] ..... G03G 15/00

[52] U.S. Cl. ..... 355/3 R; 355/3 DR

[58] Field of Search ..... 355/3 R, 3 DR, 11, 133, 355/8

[56] References Cited

U.S. PATENT DOCUMENTS

| | | | |
|---|---|---|---|
| 3,966,316 | 6/1976 | Pfeifer et al. | 355/3 R |
| 3,997,262 | 12/1976 | Doi et al. | 355/8 X |
| 4,334,761 | 6/1982 | Saito et al. | 355/3 R |
| 4,376,577 | 3/1983 | Okamoto | 355/3 DR |
| 4,376,579 | 3/1983 | Wakao | 355/3 DR |
| 4,386,841 | 6/1983 | Wakao et al. | 355/3 DR |
| 4,412,734 | 11/1983 | Shibuya et al. | 355/3 R |
| 4,416,536 | 11/1983 | Itoh et al. | 355/3 R |

*Primary Examiner*—R. L. Moses

*Attorney, Agent, or Firm*—Beveridge, DeGrandi & Weilacher

[57] ABSTRACT

A shell-type electrostatic copying apparatus comprising a lower supporting frame, an upper supporting frame mounted on the lower supporting frame for free pivotal movement between an open position and a closed position, and a unit which includes a unit frame and a rotating drum mounted rotatably on the unit frame and adapted to be detachably mounted on the upper supporting frame. A provisional unit placing means is provided in the lower supporting frame for supporting the unit frame movably. The unit is mounted detachably on the upper supporting frame by placing the unit on the provisional unit placing means, pivoting the upper supporting frame from the open position to the closed position and then moving the unit in a specified direction.

8 Claims, 7 Drawing Figures

SHELL-TYPE ELECTROSTATIC COPYING APPARATUS

FIELDS OF THE INVENTION

This invention relates to an electrostatic copying apparatus, particularly a "shell-type" electrostatic copying apparatus.

DESCRIPTION OF THE PRIOR ART

As is well known in the art, a "shell-type" electrostatic copying apparatus has been proposed and has come into commercial acceptance which includes an upper supporting frame and a lower supporting frame connected to each other for relative pivoting movement between an open position and a closed position (usually the lower supporting frame is disposed at a given position and the upper supporting frame is mounted on the lower supporting frame in such a manner that it can freely pivot between the open and closed positions). Generally, when the upper supporting frame is pivoted with respect to the lower supporting frame and brought to the open position in the shell-type electrostatic copying apparatus, at least a considerable portion of a conveying passage for a sheet material such as a copying paper on which to form a copied image is exposed. Accordingly, this brings about the advantage that if sheet jamming occurs in the conveying passage, the sheet material can be easily taken out from it.

A conventional electrostatic copying appartus of this type, however, has problems to be solved. For example, a rotating drum is detachably mounted on the upper supporting frame pivotally mounted on the lower supporting from in this apparatus. Its mounting and detaching cannot be performed easily and rapidly. Furthermore, during the mounting or detaching operation, a photosensitive member disposed on the surface of the drum might be damaged (for example, when the operator accidentally touches the surface of the photosensitive member, or the surface of the photosensitive member contacts part of the electrostatic copying apparatus).

SUMMARY OF THE INVENTION

The present invention has been accomplished in view of the foregoing fact, and its object is to provide an improved shell-type electrostatic copying apparatus in which the rotating drum can be accurately mounted on the upper supporting frame, and its mounting and detaching can be performed easily and rapidly.

According to this invention there is provided a shell-type electrostatic copying apparatus comprising a lower supporting frame, an upper supporting frame mounted for free pivotal movement, about a axis extending in the front-rear direction, between an open position and a closed position, the upper supporting frame having a vertical front base plate and a vertical rear base plate spaced from each other in the front-rear direction, and a unit detachably mounted on the upper supporting frame, the unit including a unit frame having a wall front and a rear wall, spaced from each other in the front-rear direction, and a rotating drum rotatably mounted on the unit frame, characterized in that a provision unit placing means for supporting the unit frame of the unit for free movement over a predetermined rang the front-rear direction is provided in the lower supporting frame;

one of the front wall of the unit frame and the vertical front base plate of the upper supporting frame has formed therein at least two laterally spaced engaging openings, and the other has formed therein at least two laterally spaced engaging projections, and at least one of the rear wall of the unit frame and the vertical rear base plate of the upper supporting frame has formed therein at least two laterally spaced engaging projections and the other has formed therein at least two laterally spaced engaging openings; and a restraining means is provided for releasably restraining the movement of the unit frame in the front-rear direction with respect to the upper supporting frame.

When the unit frame is provisionally placed at a predetermined provisional placing position on the provisional unit placing means, provided on the lower supporting frame and the upper supporting frame, is pivoted from the open position to the closed position, the engaging openings formed in one of the front wall of the unit frame and the vertical front base plate of the upper supporting frame are brought into alignment in the front-rear direction with the engaging projections formed in the other, and the engaging projections formed in one of the rear wall of the unit frame and the vertical front base plate of the upper supporting frame are brought into alignment in the front-rear direction with the ongaging openings formed in the other.

When the unit frame is moved rearwardly or frontwardly from the provisional placing position to a mounting position, the engaging openings formed in one of the front wall of the unit frame and the vertical front base plate of the upper supporting frame are engaged with the engaging projections formed in the other, and the engaging projections formed in one of the rear wall of the unit frame and the vertical rear base plate of the upper supporting frame are engaged with the engaging openings formed in the other.

When thereafter the movement of the unit frame in the front-rear direction with respect to the upper supporting frame is releasably restrained by the restraining means, the unit is detachably mounted on the upper supporting frame.

Other objects and advantages of this invention will become apparent from the following description taken in conjunction with the accompanying drawings.

DETAILED DESCRIPTION OF PREFERRED EMBODIMENTS

Figure 1:
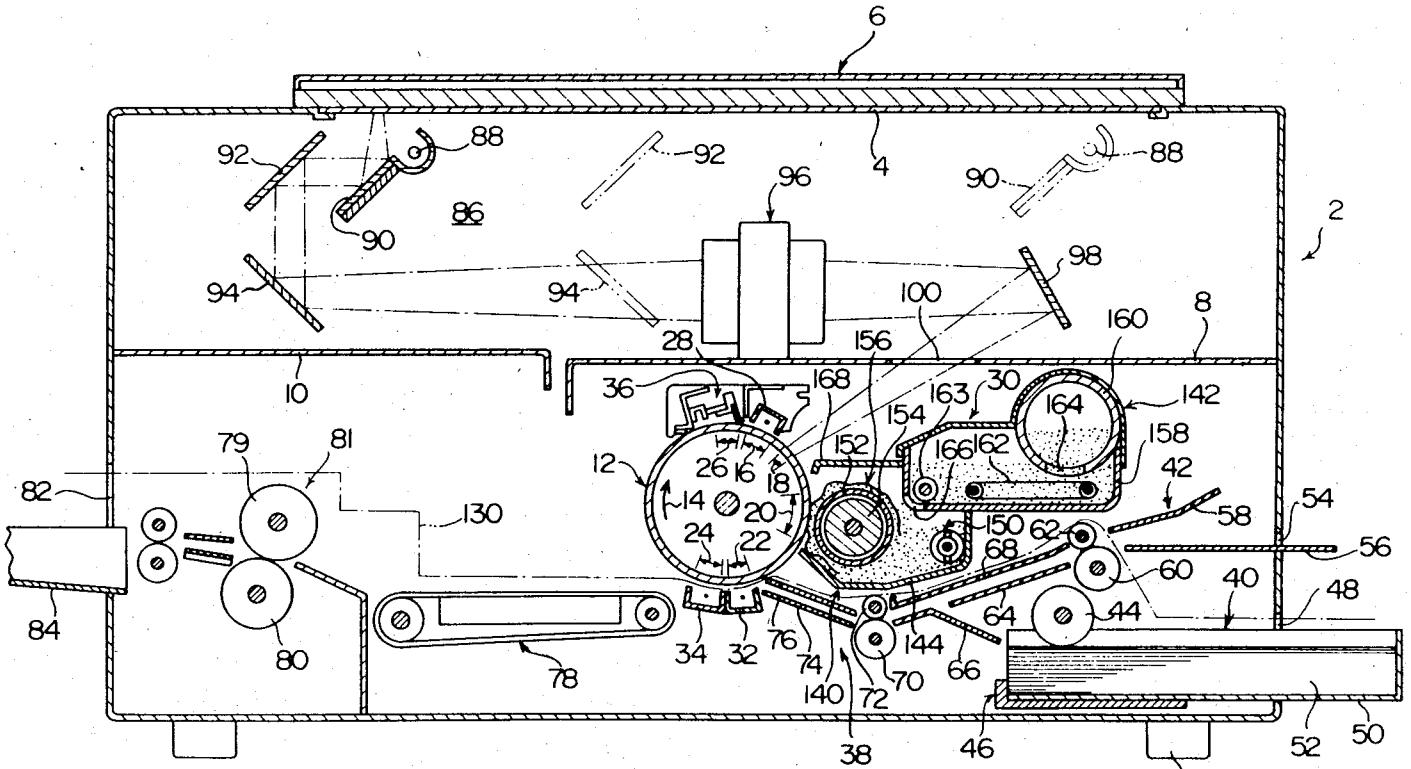
FIG. 1 is a simplified sectional view showing the structure of the electrostatic copying apparatus of this invention as a whole.

Preferred embodiments of the shell-type electrostatic copying apparatus constructed in accordance with this invention are described in detail with reference to the drawings.

First, with reference to FIG. 1, the structure of the electrostatic copying apparatus of this invention as a whole will be described.

The illustrated electrostatic copying apparatus has a nearly rectangular-parallelpipedal housing shown generally at 2. A transparent plate 4, on which to place a document or the like to be copied, is disposed on the upper surface of the housing 2. Also provided on the upper surface of the housing 2 is a document holder 6 which is openable or closable for covering the transparent plate 4 and the document thereon (in FIG. 1, the document holder 6 is shown in its closed position covering the transparent plate 4).

The inside of the housing 2 is divided into an upper space and a lower space by horizontal plates 8 and 10. A rotating drum 12, having a photosensitive member on its peripheral surface, is rotatably mounted nearly centrally in the lower space. Around the rotating drum 12, to be rotated in the direction of an arrow 14, there are provided a charging zone 16, an exposing zone 18, a developing zone 20, a transferring zone 22, a peeling zone 24 and a cleaning zone 26 in this sequence in the drum rotating direction. A charging corona discharge device 28 is disposed in the charging zone 16. A suitable developing device 30 is disposed in the developing zone. A transferring corona discharge device 32 is disposed in the transferring zone 22. A peeling corona discharge device 34 is disposed in the peeling zone 24. In the cleaning zone 26, a cleaning device 36 is provided.

A sheet material conveying device shown generally at 38 is provided in the lower part of the lower space of the housing 2. At one end, i.e. the right end in FIG. 1, of the sheet material conveying device 38 are provided a cassette-type copying paper feed device 40 and a manual sheet material feed device 42 located above the paper feed device 40. The paper feed device 40 is comprised of a paper cassette receiving section 46, having a delivery roller 44 provided therein, and a copying paper cassette 50 to be loaded into the paper cassette receiving section 46 through an opening 48 formed on the right wall of the housing 2. Copying paper sheets are delivered one by one from a layer 52 of paper sheets, accommodated in the cassette 50, by the action of the delivery roller 44. The manual feed device 42 includes a horizontal guide plate 56 projecting outwardly through an opening 54 formed on the right wall of the housing 2, a guide plate 58 located above the guide plate 56, and a pair of delivery rollers 60 and 62 located downstream (on the left side in FIG. 1) of the guide plates 56 and 58 in the sheet material conveying direction. When a suitable sheet material such as a copying paper sheet is positioned on the horizontal guide plate 56 and advanced to the nipping position of the delivery rollers 60 and 62, the delivery rollers 60 and 62 nip the sheet material and deliver it. The copying paper fed between guide plates 64 and 66 from the paper feed device 40, or the sheet material fed between guide plates 64 and 68 from the manual feed device 42, is conveyed to the transferring zone 22 and the peeling zone 24 between guide plates 74 and 76 by the action of a pair of conveying roller 70 and 72.

The copying paper or the sheet material is then conveyed by the action of a suitable conveyor belt mechanism 78, and sent to a fixing device 81 constructed of a heating roller 79 having a heater (not shown) disposed therein and a pressing roller 80 adapted to be in press contact with the heating roller 79. Thereafter, the sheet material is discharged into a receiving tray 84 through an opening 82 formed in the left wall of the housing 2.

On the other hand, an optical unit shown generally at 86 is provided in the upper space above the horizontal plates 8 and 10 within the housing 2 for scanning and exposing the document placed on the transparent plate 4 and projecting the image of the document onto the photosensitive member on the rotating drum 12 in the exposing zone 18. The optical unit 86 has a document illuminating lamp 88 for illuminating the document on the transparent plate 4, and a first reflecting mirror 90, a second reflecting mirror 92, a third reflecting mirror 94, a lens assembly 96 and a fourth reflecting mirror 98 for projecting the light reflected from the document onto the photosensitive member. During scanning and exposure, the document illuminating lamp 88 and the first reflecting mirror 90 are moved at a given speed V substantially horizontally from a scan-exposure starting position shown by a solid line to a given position (for example, a maximum scan-exposure end position) shown by a two-dot chain line, and the second reflecting mirror 92 and the third reflecting mirror 94 are moved at a speed (V/2) one-half of the above given speed V from a scan-exposure starting position shown by a solid line to a given position (for example, a maximum scan-exposure end position) shown by a two-dot chain line. In the meantime, the reflected light from the document illuminated by the illuminating lamp 88 is reflected successively by the first, second and third reflecting mirrors 90, 92 and 94 and reaches the lens assembly 96. Then, it is reflected by the fourth reflecting mirror 98 and reaches the photosensitive member in the exposing zone 18 via an opening 100 formed in the horizontal plate 8. When the scan-exposure is over, the document illuminating lamp 88 and the first, second and third reflecting mirrors 90, 92 and 94 are returned to the scan-exposure start position shown by the solid line.

In the copying apparatus described above, while the rotating drum 12 is rotated in the direction of arrow 14, the charging corona discharge device 28 charges the photosensitive member substantially uniformly to a specified polarity in the charging zone 16, and then in the exposing zone 18, the optical unit 86 projects the image of the document onto the photosensitive member to form thereon a latent electrostatic image corresponding to the document. Then, in the developing zone 20, a toner is applied to the latent electrostatic image on the photosensitive member by the developing device 30 to develop it to a toner image. In the transferring zone 22, a sheet material such as a copying paper sheet fed from the paper feed device 40 or the manual sheet feed device 42 is brought into contact with the photosensitive member. As a result, the toner image is transferred from the photosensitive member to the sheet material by the action of the transferring corona discharge device 32. The sheet material is then peeled off from the photosensitive member in the peeling zone 24 by the action of the peeling corona discharge device 34. The sheet material having the toner image transferred thereto is then conveyed to the fixing device 81 to fix the toner image under heat, and finally discharged into the receiving tray 84. In the meanwhile, the photosensitive material continues to rotate and in the cleaning zone 26, the toner and electrostatic charge remaining on the photosensitive member after the transfer are removed by the action of the cleaning device 36.

Figure 2:
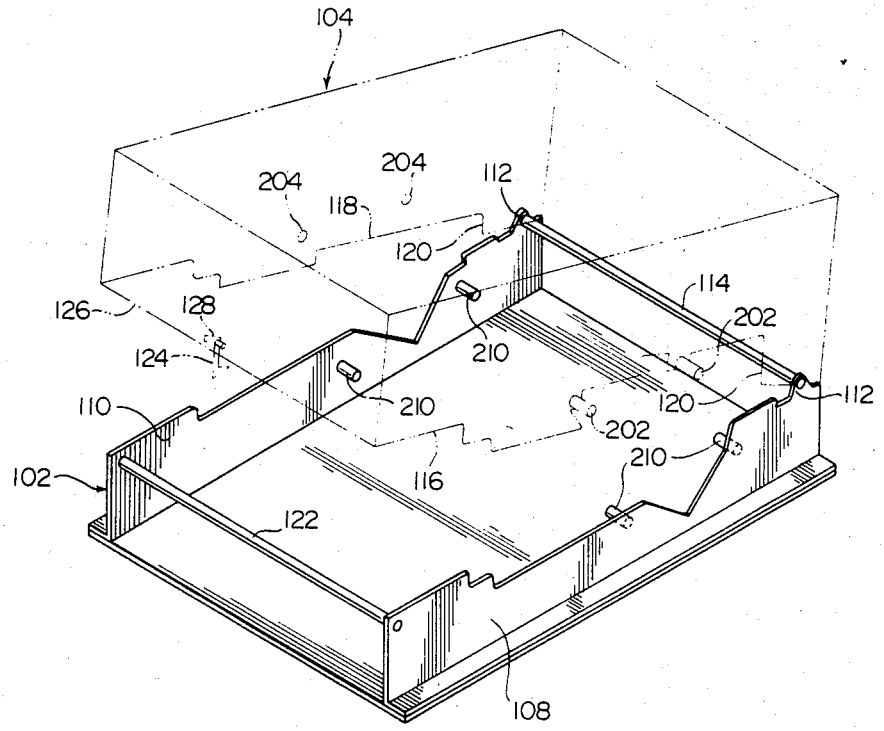
FIG. 2 is a simplified view showing a shell-type supporting structure in the electrostatic copying apparatus of FIG. 1.

The electrostatic copying apparatus illustrated in FIG. 1 has a so-called shell-type supporting structure comprised of a lower supporting frame 102 and an upper supporting frame 104 (shown by a two-dot chain line in FIG. 2) as shown in FIG. 2.

With reference to FIG. 2, a supporting leg 106 (FIG. 1) is provided on the lower surface of the lower supporting frame 102. By positioning the supporting leg 106 on the upper surface of a supporting table (not shown) for example, the lower supporting frame 102 is placed at a given position. The lower supporting frame 102 has a vertical front base plate 108 and a vertical rear base plate 110 which are spaced from each other by a predetermined distance in the front-rear direction (i.e., the direction perpendicular to the sheet surface in FIG. 1, the direction extending from right bottom toward left top in FIG. 2, and the left-right direction in FIGS. 4 and 5). Upwardly projecting supporting projections 112 are formed respectively at the right end portions of the vertical front base plate 108 and the vertical rear base plate 110 of the lower supporting frame 102. A pivot supporting shaft 114 extending in the front-rear direction is mounted across the supporting projections 112. The front and rear ends of the pivot supporting shaft 114 project slightly frontwardly and rearwardly beyond the supporting projections 112 of the vertical front base plate 108 and the vertical rear base plate 110.

Figure 4:
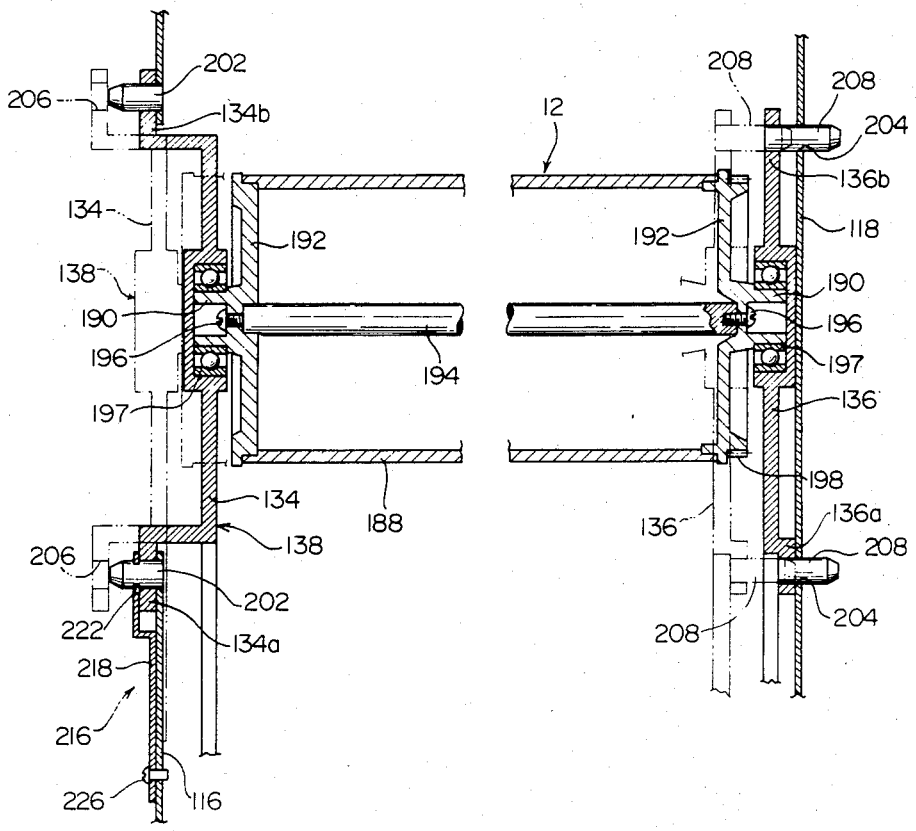
FIG. 4 is a sectional view, partly omitted, of the state in which a unit is mounted on an upper supporting frame in the electrostatic copying apparatus of FIG. 1.
Figure 5:
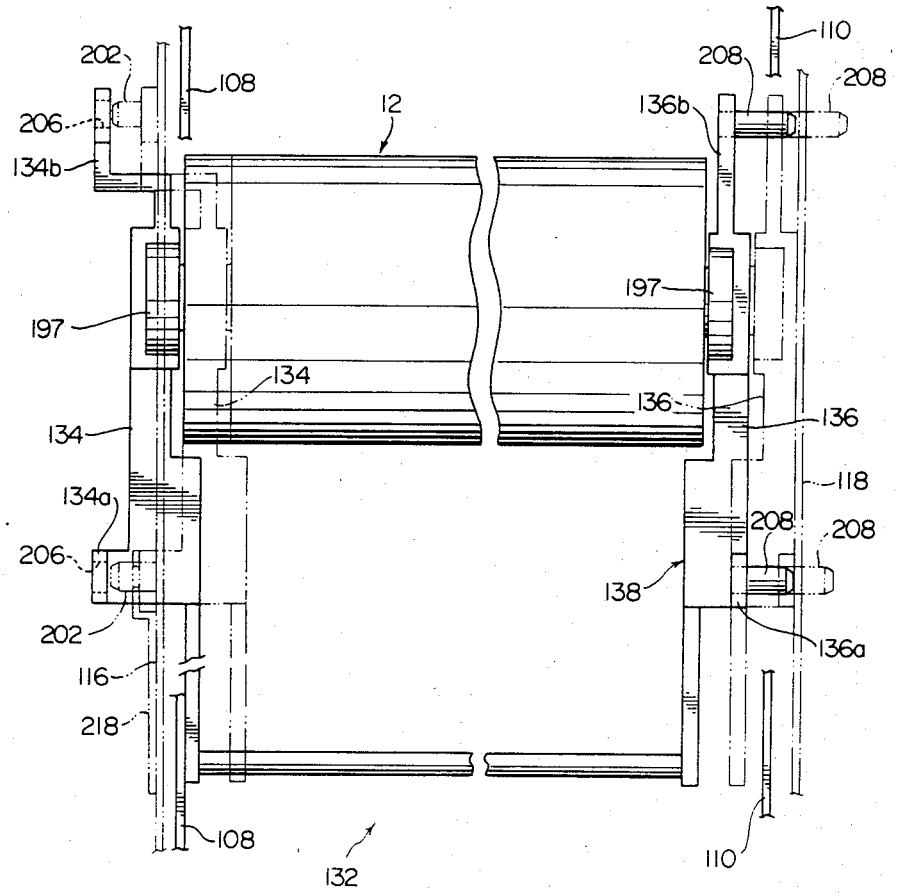
FIG. 5 is a top plan view, partly omitted, of the state in which a unit is placed on a provisional unit placing means in a lower supporting frame in the electrostatic copying apparatus.

The upper supporting frame 104 also has a vertical front base plate 116 and a vertical rear base plate 118 spaced from each other at a predetermined distance in the front-rear direction (i.e., the direction perpendicular to the sheet surface in FIG. 1, the direction extending from right bottom toward left top in FIG. 2, and in the left-right direction in FIGS. 4 and 5). The distance between the vertical front base plate 116 and the vertical rear base plate 118 of the upper supporting frame 104 in the front-rear direction is slightly larger than the distance between the vertical front base plate 108 and the vertical rear base plate 110 of the lower supporting frame 102 in the front-rear direction. The vertical front base plate 116 and the vertical rear base plate 118 of the upper supporting frame 104 are located slightly frontwardly and rearwardly of the vertical front base plate 108 and the vertical rear base plate 110 of the lower supporting frame 102 (see FIG. 5). Downwardly projecting supportable portions 120 are formed respectively in the right end portions of the vertical front base plate 116 and the vertical rear base plate 118, and a nearly semi-circular recess is formed in the lower edge of each of these supportable portions 120. The nearly semi-circular recesses formed in the supportable portions 120 are engaged with the two end portions of the pivot supporting shaft 114 mounted on the lower supporting frame 102 (i.e., the front and rear end portions projecting frontwardly and rearwardly respectively beyond the vertical front base plate 108 and the vertical rear base plate 110 of the lower supporting frame 102), and as a result, the upper supporting frame 104 is pivotally mounted on the lower supporting frame 102 about the pivot supporting shaft 114 as a center (the central axis of the supporting shaft 114 becomes the central axis of pivoting of the upper supporting frame 104 extending in the front-rear direction). A restraining member (not shown) having a hole through which the pivot supporting shaft 114 extends is fixed to each of the supportable projections 120 of the upper supporting frame 104, whereby the upward movement of the upper supporting frame 104 is accurately hampered.

Between the lower supporting frame 102 and the upper supporting frame 104 mounted pivotally on the lower supporting frame 102 is interposed a spring member (not shown) for elastically biasing the upper supporting frame 104 with respect to the lower supporting frame 102 about the pivot supporting shaft 114 as a center in the clockwise direction in FIG. 2 (more specifically, in the clockwise direction as viewed from right bottom toward left top in FIG. 2). The spring means is composed of a pair of compression coil springs (not shown). One end of one of the compression coil springs is mounted on the front surface of the vertical front base plate 108 of the lower supporting frame 102, and the other end, on the front surface of the vertical front base plate 116 of the upper supporting frame 104. Furthermore, one end of the other compression coil spring is mounted on the rear surface of the vertical rear base plate 110 of the lower supporting frame 102 and the other end, on the rear surface of the vertical rear base plate 118 of the upper supporting frame 104. The spring means (not shown) described above biases the upper supporting frame 104 clockwise in FIG. 2 about the pivot supporting shaft 114 as a center. When the upper supporting frame 104 is pivoted clockwise in FIG. 2 by the elastic biasing action of the spring means, the elastic biasing force of the spring member becomes gradually smaller with the pivoting of the upper supporting frame 104. When the upper supporting frame 104 has been pivoted to the open position shown in FIG. 2 (shown by the two-dot chain line in FIG. 2), the elastic biasing force of the spring means to pivot the upper supporting frame 104 clockwise in FIG. 2 about the pivot supporting shaft 114 as a center is brought into equilibrium with the moment tending to pivot the upper supporting frame 104 counterclockwise in FIG. 2 (counterclockwise as viewed from right bottom toward left top in FIG. 2) owing to the own weight of the upper supporting frame 104 and various constituent element mounted thereon, and consequently, the upper supporting frame 104 is held at the open position shown in FIG. 2. The spring means is substantially the same as that described in the specification and drawings of Japanese Patent Application No. 209849/1982 filed Nov. 30, 1982 for "ELECTROSTATIC COPYING APPARATUS", and for a detailed description of the spring means, reference may be had to the specification and drawings of Japanese Patent Application No. 209849/1982.

The lower supporting frame 102 and the upper supporting frame 104 are further equipped with a locking mechanism for locking the upper supporting frame 104 in a closed position against the elastic biasing action of the spring means (when the upper supporting frame 104 is held at the closed position, various constituent elements mounted on the lower supporting frame 102 and various constituent elements mounted on the upper supporting frame 104 are held at the position shown in FIG. 1 and consequently, the apparatus is ready for copying). The locking mechanism in the illustrated embodiment has an engaging shaft 122 and a hook 124 as shown in FIG. 2. The engaging shaft 122 is provided across the left end portion of the vertical front base plate 108 and the left end portion of the vertical rear base plate 110 in the lower supporting frame 102, and the hook 124 is pivotally mounted on a supporting pin implanted in a vertical side base plate 126 in the upper supporting frame 104. A suitable spring member (not shown) is mounted on the hook 124. Hence, the hook 124 is elastically biased counterclockwise in FIG. 2 (more specifically, counterclockwise from right bottom toward left top in FIG. 2) and is elastically held at the angular position (shown by two-dot chain line in FIG. 2) by the action of the spring member. The lower edge of the hook 124 is inclined upwardly to the right in FIG. 2. Furthermore, an operating piece 128 projecting to the left is provided in the hook 124.

When the upper supporting frame 104 is pivoted counterclockwise from the open position (shown by the two-dot chain line) shown in FIG. 2 to near the aforesaid closed position about the pivot supporting shaft 114 as a center against the elastic biasing action of the spring means (not shown), the lower edge of the hook 124 contacts the engaging shaft 122, and thereby, the hook 124 is pivoted clockwise about the supporting pin as a center. When the upper supporting frame 104 is pivoted to the closed position, the lower edge of the hook 124 is positioned below the engaging shaft 122 and therefore, returned to the angular position shown in the drawing (shown by a two-dot chain line) by the elastic biasing action of the spring member (not shown) and comes into engagement with the engaging shaft 122. As a result, the upper supporting frame 104 is accurately locked at the closed position against the elastic biasing action of the spring means. On the other hand, when the operating piece 128 of the hook 124 is manually operated to pivot the hook 124 clockwise in FIG. 2 and disengage it from the engaging shaft 122, the upper supporting frame 104 is pivoted from the closed position to the open position shown in FIG. 2 (shown by the two-dot chain line) by the elastic biasing action of the spring means.

Referring to FIG. 1 in conjunction with FIG. 2, constituent elements located below the one-dot chain line 130 in FIG. 1 (the copying paper feed device 40, the transferring corona discharge device 32, the peeling corona discharge device 34, the conveyor belt mechanism 78, the fixing device 81, etc.) are mounted on the lower supporting frame 102. Constituent elements of the illustrated electrostatic copying apparatus which are located above the one-dot chain line 130 in FIG. 1 (the rotating drum 12, the charging corona discharge device 28, the developing device 30, the cleaning device 36, the optical unit 86, etc.) are mounted on the upper supporting frame 104.

In the aforesaid electrostatic copying apparatus, the rotating drum 12 and the developing device 30 are constructed as a unit in order to mount and detach them easily and rapidly for repair, inspection, cleaning, replacing, etc. The unit is detachably mounted on the upper supporting frame 104.

Figure 3:
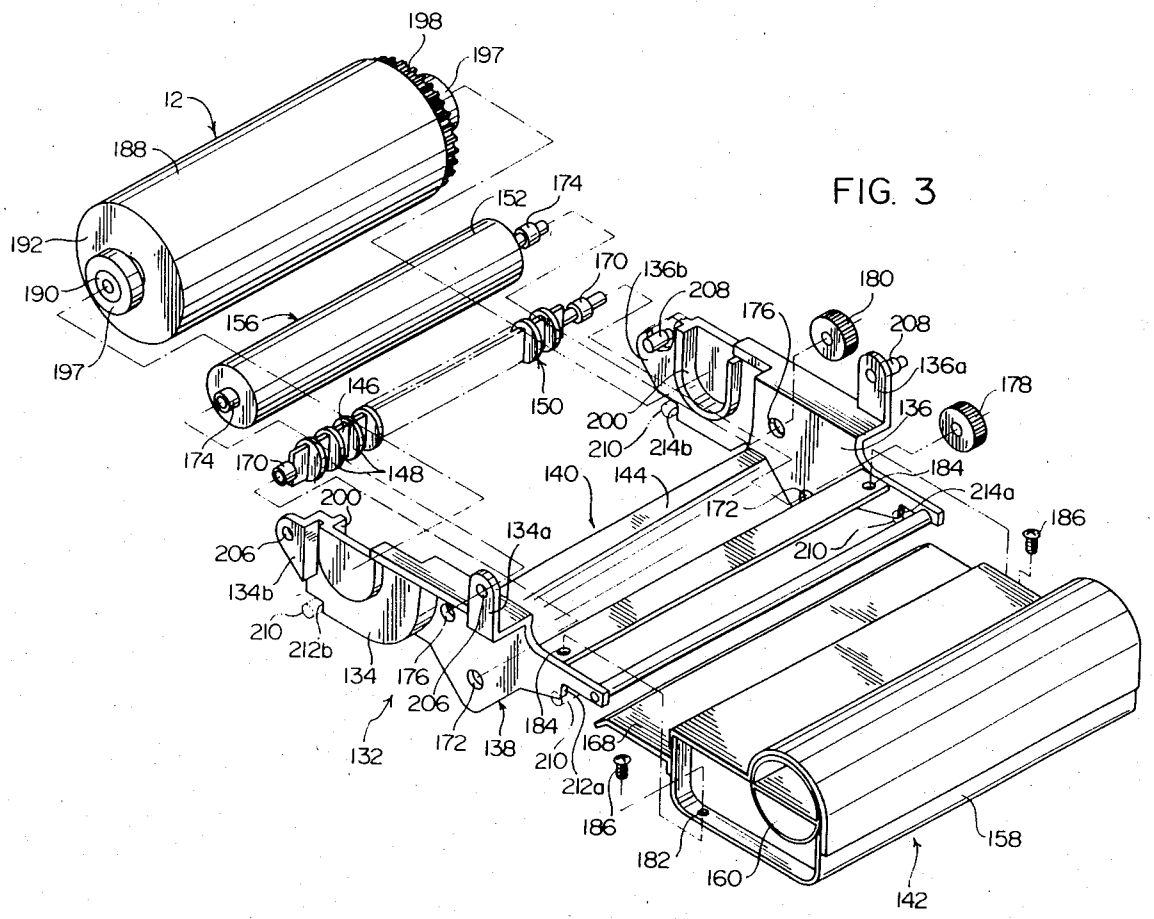
FIG. 3 is an exploded perspective view of a unit in the electrostatic copying apparatus of FIG. 1.

With reference to FIGS. 1, 3 and 4, mainly to FIGS. 3 and 4, the aforesaid unit will be described. The unit shown generally at 132 includes a unit frame 138 having a front wall 134 and a rear wall 136 spaced from each other in the front-rear direction (in the direction perpendicular to the sheet surface in FIG. 1, the direction extending from left bottom toward right top in FIG. 3, and in the left-right direction in FIGS. 4 and 5), and the rotating drum 12 and the developing device 30 are mounted on the unit frame 138.

With reference to FIGS. 3 and 1, the developing device 30, which may be in a known type, is comprised of a developing mechanism 140 and a toner supply mechanism 142. The developing mechanism 140 is comprised of a developer receptacle 144 for holding a developer composed of a toner and carrier, a stirring means 150 having a stirring plate 146 and a plurality of nearly semi-circular stirring vanes 148 disposed on both surfaces of the stirring plate 146, and a magnetic brush means 156 having a cylindrical sleeve 152 and a roll-like stationary permanent magnet 154 (FIG. 1) disposed within the sleeve 152. The stirring means 150 is rotated counterclockwise in FIG. 1 and stirs the developer in the developer receptacle 144 thereby triboelectrically charging the toner. The sleeve 152 of the magnetic brush means 156 is rotated clockwise in FIG. 1. The sleeve 152 holds the developer on its surface by the magnetic attracting force of the permanent magnet 154 disposed therein, and applies the developer to the photosensitive member on the rotating drum 12, thereby causing selective adhesion of the toner to the photosensitive member according to the latent electrostatic image formed on the photosensitive member. The toner supply mechanism 142 includes a toner holding receptacle 158, a hollow cylindrical toner cartridge 160 mounted above one end portion of the toner receptacle 158, a toner conveying means 162 (FIG. 1) disposed within the toner receptacle 158, and a toner supply means 163. The toner cartridge 160 has a discharge opening 164 openable at a predetermined angular position on its peripheral side wall as shown in FIG. 1. After opening the discharge opening 164, the toner cartridge 160 is inserted into the toner receptable 158 through a circular opening formed in the front surface of the toner receptacle 158 while the discharge opening 164 is located upwardly. Then, the toner cartridge 160 is turne to the state shown in FIG. 1 in which its discharge opening 164 is located downwardly. As a result, the toner held in the toner cartridge 160 is discharged downwardly through the discharge opening 164 and supplied to the toner receptable 158. The toner conveying means 162 which may be of any suitable type located below the discharge opening 164 is driven by a toner supplying motor (not shown) mounted on the rear surface of the toner receptable 158 to convey the toner discharged from the discharge opening 164 of the toner cartridge 160 to the left in FIG. 1. The toner supplying means 163 which may be of any desired type disposed in the lower portion of the left end of the toner receptacle 158 is rotated by the aforesaid motor (not shown) and supplies the toner conveyed by the toner conveying means 162 to the developer receptacle 144 of the developing mechanism 140 through an opening 166 formed in the left end of the toner receptacle 158. To the left end wall of the toner receptacle 158 is fixed a cover 168 extending to the left therefrom for covering the upper portion of the developing mechanism 140.

The method of mounting the developing device 30 on the unit frame 138 will be described with reference mainly to FIG. 3. The developer receptacle 144 is fixed between the front wall 134 and the rear wall 136 of the unit frame 138 by screwing setscrews (not shown) into the front wall 134 and the rear wall 136. The stirring means 150 of the developing mechanism 140 has shaft supporting members 170 having a circular peripheral surface and mounted respectively in the front end portion and rear end portion of the stirring means 150. By mounting the shaft supporting members 170 on holes 172 formed in the front wall 134 and the rear wall 136 respectively of the unit frame 138, the stirring means 150 is rotatably mounted across the front wall 134 and the rear wall 136 of the unit frame 138. Likewise, the magnetic brush means 156 has supporting members 174 having a circular peripheral surface mounted on its front end portion and rear end portion respectively, and by mounting the supporting members 174 on holes 176 formed in the front wall 134 and rear wall 136 of the unit frame 138, the magnetic brush means 156 is rotatably mounted across the front wall 134 and the rear wall 136 of the unit frame 138.

Gears 178 and 180 are fixed respectively to the rear end of the stirring means 150 (rearwardly of the shaft supporting member 170 mounted on the rear end portion) and the rear end of the magnetic brush means 156 (rearwardly of the supporting member 174 mounted on the rear end portion). The gears 178 and 180 are brought into mesh with each other. One gear 180 is drivingly connected to a driving source (not shown) such as an electric motor constituting a main driving source for the electrostatic copying apparatus through a suitable power transmission mechanism when the unit 132 is mounted in place on the upper supporting frame 104. The integrally assembled toner supply mechanism 142 is fixed to the developer receptacle 144 by screwing setscrews 186 into screw holes 184 formed in a projecting portion existing in the right end portion of the developer receptacle 144 through holes 182 formed in projecting portions existing in the front surface and rear surface of the toner receptacle 158.

The structure of the rotating drum 12 will now be described briefly with reference to FIGS. 3 and 4. The illustrated rotating drum 12 has a cylindrical sleeve-like drum body 188. In the illustrated embodiment, a photosensitive member is disposed on the entire circumference of the drum body 188 over its substantially entire width. A side plate 192 in the form of a disc having a boss portion 190 formed therein is provided at both ends of the drum body 188. The side plates 192 are fixed to both sides of the drum body 188 by screwing fixing screws 196 into a drum supporting shaft 194 disposed approximately centrally within the drum body 188 through holes formed in the boss portions 190 of the side plates 192. Bearing members 197 are mounted respectively on the boss portions 190 of the side plates 192. A gear portion 198 is formed on the entire peripheral surface of the rear end portion of the rotating drum 12 (more specifically on the entire peripheral surface of the rear end of the rearwardly located side plate 192).

The method of mounting the rotating drum 12 on the unit frame 138 will be described mainly with reference to FIG. 3. An upwardly opened semi-circular receiving portion 200 is formed both on the rear surface of the front wall 134 of the unit frame 138 and on the front surface of the rear wall 136. The rotating drum 12 is rotatably mounted across the front wall 134 and the rear wall 136 of the unit frame 138 by inserting the bearing members 197 into the receiving portions 200 from above. Restraining pieces (not shown) having a semicircular recess at their lower end are fixed respectively to the rear surface of the vertical front base plate 116 and the front surface of the vertical rear base plate 118 of the upper supporting frame 104 on which the unit frame 138 is to be mounted. When the unit 132 is mounted in place on the upper supporting framb 104 in the manner to be described, the recesses of the restraining pieces contact the upper half surface of the bearing members 197 mounted on the two ends of the rotating drum 12 immediately inwardly of the receiving portions 200, and thus accurately prevent the bearing members 197 (and therefore the rotating drum 12) from moving upwardly from the receiving portions 200. When the unit 132 is mounted in place on the upper supporting frame 104, the gear portion 198 formed at the rear end portion of the rotating drum 12 is drivingly connected to the driving source (not shown) such as an electric motor constituting the main driving source for the electrostatic copying apparatus through a linking mechanism to be described hereinafter.

Now, the method of mounting the unit 132 comprising the rotating drum 12 and the developing device 30 will be described with reference to FIGS. 2 to 5. As shown in FIGS. 2, 4 and 5, two engaging pins 202 (constituting engaging projections) projecting frontwardly in the front-rear direction and spaced from each other laterally (the left-right direction in FIG. 1, the direction extending from left bottom toward right top in FIG. 2, and in the up-and-down direction in FIGS. 4 and 5) are implanted in the front surface of the vertical front base plate 116 of the upper supporting frame 104, and two laterally spaced engaging openings 204 are formed in the vertical rear base plate 118 of the upper supporting frame 104. On the other hand, as shown in FIGS. 3 to 5, two engaging openings 206 engageable with the engaging pins 202 implanted in the vertical front base plate 116 of the upper supporting frame 104 are formed at laterally spaced positions in the front wall 134 of the unit frame 138 (more specifically, one engaging opening 206 is formed in a projecting portion **134*a* formed in the upper end of the front wall 134 of the unit frame 138, and the other engaging opening 206 is formed in a projecting portion 134*b* formed in the left end of the front wall 134). Furthermore, two engaging pins 208 (constituting engaging projections) which project rearwardly in the front-rear direction at laterally spaced positions and can be engaged with the engaging openings 204 formed in the vertical rear base plate 118 of the upper supporting frame 104 are implanted in the rear surface of the rear wall 136 of the unit frame 138 (more specifically, one engaging pin 208 is implanted in the rear surface of a projecting portion 136*a* formed in the upper end of the rear wall 136 and the other engaging pin 208, in the rear surface of the left end portion 136*b* of the rear wall 136). In the illustrated embodiment, the engaging openings 206 are formed in the front wall 134 of the unit frame opposite to the engaging pins 202 implanted in the vertical front base plate 116 of the upper supporting frame 104. If desired, it is possible to form the aforesaid engaging openings in the vertical front base plate 116 and implant the engaging pins in the front wall 134 of the unit frame 138 opposite to the engaging openings. Furthermore, in the illustrated embodiment, the engaging pins 208 are implanted in the rear end wall 136 of the unit frame 138 opposite to the engaging openings 204 formed in the vertical rear base plate 118 of the upper supporting frame 104. If desired, the engaging pins may be implanted in the vertical rear base plate, and the engaging openings, in the rear wall 136 of the unit frame 138**.

The lower supporting frame 102 further has provided therein a provisional unit placing means (FIG. 2) which temporarily supports the unit frame 138. With reference to FIG. 2, the provisional unit placing means is comprised of four supporting pins 210. Two supporting pins 210 projecting rearwardly in the frontrear direction are implanted in the rear surface of the vertical front base plate 108 of the lower supporting frame 102 at laterally (in the front-rear direction in FIG. 1, the direction extending from left bottom to right top in FIG. 2, and the up-and-down direction in FIGS. 4 and 5) spaced positions, and two supporting pins 210 projecting frontwardly in the front-rear direction are implanted on the front surface of the vertical rear base plate 110 of the lower supporting frame 102 at laterally spaced positions. In the privisional unit placing means, the front wall 134 of the unit frame 138 is placed on the supporting pins 210 implanted in the vertical front base plate 108 of the lower supporting frame 102 (more specifically, a recess 212*a* formed in the lower edge of the right end portion of the front wall 134 is placed on one of the supporting pins 210, and a recess 212*b* formed in the lower edge of the left end portion of the front wall 134, on the other supporting pin 210). Furthermore, the rear wall 136 of the unit frame 138 is placed on the supporting pins 210 implanted in the vertical rear base plate 110 of the lower supporting frame 102 (more specifically, a recess 214*a* formed in the lower edge of the right end portion of the rear wall 136 is placed on one of the supporting pins 210, and a recess 214*b* formed in the lower edge of the left end portion of the rear wall 136, on the other supporting pin 210). The electrostatic copying apparatus of this invention is further constructed such that as can be seen from FIG. 5, when the unit 132 is placed on the provisional unit placing means (FIG. 2), the front surface of the right end portion of the front wall 134 of the unit frame 138 is guided by the rear surface of the vertical front base plate 108 of the lower supporting frame 102, and the end surface of one of the engaging pins 208 implanted in the rear wall 136 of the unit frame 138 (in the illustrated embodiment, that engaging pin 208 which is implanted in the rear surface of the projecting portion 136*a* formed in the upper end of the rear wall 136) is guided by the front surface of the vertical rear base plate 118 of the upper supporting frame 104. Hence, when the unit 132 is placed on the provisional unit placing means, the front surface of the front wall 134 of the unit frame 138 contacts the rear surface of the vertical front base plate 108 of the lower supporting frame 102 to hamper the frontward movement of the unit frame 138, and moreover, the end surface of the engaging pin 208 implanted in the rear wall 136 of the unit frame 138 contacts the front surface of the vertical rear base plate 118 of the upper supporting frame 104 to hamper the rearward movement of the unit frame 138.

In the illustrated embodiment, the provisional unit placing means on which to place the unit frame 138 provisionally is constructed of a plurality of supporting pins 210. Instead, it is possible to form recesses for provisional placing in the vertical front base plate 108 and the vertical rear base plate 110 of the lower supporting frame 102, implant pins for provisional placing adapted to be placed on the recesses in the front wall 134 and the rear wall 136 of the unit frame 138, and constitute the provisional unit placing means from the recesses formed in the vertical front base plate 108 and the vertical rear base plate 110.

Figure 6:
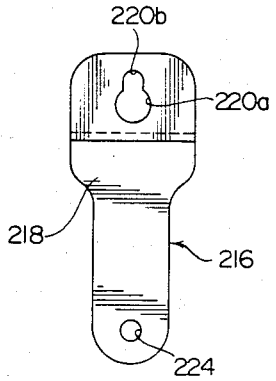
FIG. 6 is an enlarged front elevational view showing a restraining means in the electrostatic copying apparatus of FIG. 1.

The electrostatic copying apparatus described above has further provided therein a restraining means 216 shown in FIG. 4 for restraining the frontward and rearward movement of the unit frame 138 mounted in place on the upper supporting frame 104 as described below. The restraining means 216 in the illustrated embodiment is comprised of a restraining member 218 shown in FIG. 6. At one end portion of the restraining member 218, there are formed a large opening portion 220*a* having a slightly larger diameter than the diameter of one engaging pin 202 implanted in the vertical front base plate 116 of the upper supporting frame 104, and a small opening portion 220*b* having a smaller diameter than the engaging pin 202 and communicating with the large opening portion 220*a*. The engaging pin 202 has formed therein a groove 222 (FIG. 4) having a slightly smaller diameter than the diameter of the small opening portion 220*b* of the restraining member 218. The restraining member 218 is mounted in place on the upper supporting frame 104 by engaging the small opening portion 220*b* with the groove 222 of the engaging pin 202 and thereafter screwing a setscrew 226 into the vertical front base plate 116 of the upper supporting frame 104 through a hole 224 (FIG. 6) formed at the other end portion of the restraining member 218.

In the illustrated embodiment, the frontward and rearward movement of the unit frame 138 is hampered by engaging the restraining member 218 with one of the engaging pins 202 implanted in the vertical front base plate 116 of the upper supporting frame 104. To hamper the frontward and rearward movement of the unit frame 138 more accurately, it is possible to engage the restraining member 218 also with the other engaging pin 202 implanted in the vertical front base plate 116 and the engaging pin 208 implanted in the rear wall 136 of the unit frame 138. Furthermore, in the illustrated embodiment, the restraining member 218 having formed therein the large opening portion 220*a* and the small opening portion 220*b* is used as the restraining means 216. However, the restraining means 216 is not limited to the restraining member 218, and any means known per se which releasably restrains the frontward and rearward movement of the unit frame 138 may be used.

In the electrostatic copying apparatus having the above structure, the unit 132 having the rotating drum 12 and the developing device 30 is mounted on, and detached from, the upper supporting frame 104 in the following manner.

With reference mainly to FIGS. 2, 4 and 5, in mounting the unit 132 on the upper supporting frame 104, the upper supporting frame 104 is pivoted relative to the lower supporting frame 102 to bring it to an open position shown in FIG. 2 (shown by a two-dot chain line), and the unit 132 is placed on the provisional unit placing means provided in the lower supporting frame 102. As a result, the recesses 212*a* and 212*b* formed in the front wall 134 of the unit 132 are placed on the supporting pins 210 implanted in the vertical front base plate 108 of the lower supporting frame 102, and the recesses 214*a* and 214*b* formed in the rear wall 136 of the unit 132 are placed on the supporting pins 210 implanted in the vertical rear base plate 110 of the lower supporting frame 102. It will be easily seen from FIG. 3 that consequently, the horizontal edge portions of the recesses 212*a* and 212*b* formed in the front wall 134 of the unit frame 138 abut against the upper ends of the supporting pins 210 implanted in the vertical front base plate 108 of the lower supporting frame 102, and at the same time, the horizontal edge portions of the recesses 214*a* and 214*b* formed in the rear wall 136 of the unit frame 138 abut against the upper ends of the supporting pins 210 implanted in the vertical rear base plate 110 of the lower supporting frame 102, thereby hampering the downward movement of the unit frame 138 in the up-and-down direction. Furthermore, the left vertical edge portion of the recess 212*a* formed in the front wall 134 abuts against the left end of one of the supporting pins 210 implanted in the vertical front base plate 108 and the left vertical edge portion of the recess 214*a* formed in the rear wall 136 abuts against the left end of one supporting pin 210 implanted in the vertical rear base plate 110, thereby hampering the rightward movement of the unit frame 138 in the lateral direction. Moreover, the right vertical edge portion of the recess 212*b* formed in the front wall 134 abuts against the right end of the other supporting pin 210 implanted in the vertical front base plate and the right vertical edge portion of the recess 214*b* formed in the rear wall 136 abuts against the right end of the other supporting pin 210 implanted in the vertical rear base plate 110, thereby hampering the left movement of the unit frame 138 in the lateral direction. In addition, a part of the front wall 134 of the unit 132 (more specifically, the front surface of the right end portion of the front wall 134) contacts the rear surface of the vertical front base plate 108 of the lower supporting frame 102 and the end surface of one engaging pin 208 implanted in the rear wall 136 of the unit 132 (that engaging pin 208 which is implanted in the projecting portion 136*a* of the rear wall 136) contacts the front surface of the vertical rear base plate 118 of the upper supporting frame 104 whereby the unit 132 is accurately held in place at a provisional placing position on the provisional unit placing means (the position shown by a two-dot chain line in FIG. 4 and a solid line in FIG. 5).

Thereafter, the upper supporting frame 104 is pivoted to bring it to its closed position from its open position. When the upper supporting frame 104 is held at the closed position, the engaging openings 206 formed in the front wall 134 of the unit frame 138 and the engaging pins 202 implanted in the vertical front base plate 116 of the upper supporting frame 104 are brought into alignment in the front-rear direction as shown in FIGS. 4 and 5, and at the same time, the engaging pins 208 implanted in the rear wall 136 of the unit frame 138 and the engaging openings 204 formed in the vertical rear base plate 118 of the upper supporting frame 104 are brought into alignment in the front-rear direction. Consequently, the rear movement of the unit frame 138 in the front-rear direction becomes possible.

In the next place, the unit 132 placed on the provisional unit placing means is moved rearwardly to bring it to a mounting position (the position shown by a solid line in FIG. 4 and a two-dot chain line in FIG. 5) from the provisional placing position. As will be readily seen from FIGS. 4 and 5, when the unit 132 is moved rearwardly, the rear surface of the upper end edge of the rear wall 136, the rear surface of the projecting portion 136*a* and the rear surface of the receiving section 200 abut against the front surface of the vertical rear base plate 118 of the upper supporting frame 104 and at the same time the rear surface of the projecting portion 134*a* of the front wall 134 and the rear surface of the projecting end portions 134*b* abut against the front surface of the vertical front base plate 116, thereby hampering the rearward movement of the unit frame 138. Thus, the unit 132 is accurately brought from the provisional placing position (shown by a two-dot chain line in FIG. 4 and a solid line in FIG. 5) to the mounting position and held there. When the unit 132 is held at the mounting position, the engaging openings 206 formed in the front wall 134 of the unit 132 are engaged with the engaging pins 202 implanted in the vertical front base plate 116, and the engaging openings 204 formed in the vertical rear base plate 118 are engaged with the engaging pins 208 implanted in the rear wall 136, thereby mounting the unit 132 on the upper supporting frame 104. Furthermore, it is clearly seen from FIG. 4 that when the unit 132 has been held at the mounting position, the groove 222 formed in the engaging pin 202 is located slightly frontwardly of the front wall 134 of the unit frame 138 in the front-rear direction.

After the foregoing procedure, the restraining member 218 is mounted on the vertical front base plate 116 of the upper supporting frame 104. The mounting of the restraining member 218 is accomplished by inserting its large opening portion 220*a* into the engaging pin 202, then engaging its small opening portion 220*b* with the groove 222 of the engaging pin 202, and screwing the setscrew 226 into the vertical front base plate 116 of the upper supporting frame 104 through the hole 224 formed in the other end portion of the restraining member 218. As a result, the small opening portion 220*b* is engaged with the groove 222 of the engaging pin 202, and therefore, the movement of the unit 132 relative to the upper supporting frame 104 in the front-rear direction is hampered, and the unit 132 is accurately mounted on the upper supporting frame 104.

To detach the unit 132 from the upper supporting frame 104, the restraining member 218 is first detached from the vertical front base plate 116 of the upper supporting frame 104, and then the unit 132 is moved frontwardly to bring it to the provisional placing position. Furthermore, the engagement between the hook 124 and the engaging shaft 122 is released to hold the upper supporting frame 104 at the open position. Thereafter, the unit 132 is lifted from the provisional placing position on the provisional placing means.

Figure 7:
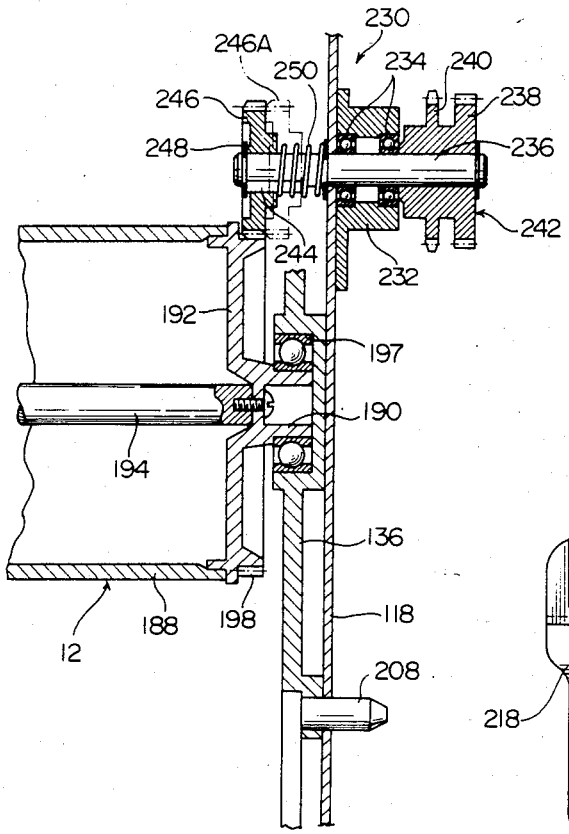
FIG. 7 is a sectional view showing the rear end portion of a rotating drum and its neighborhood in the electrostatic copying apparatus of FIG. 1.

Now, with reference to FIG. 7, a linking mechanism is described which is adapted to be drivingly connected to the gear portion 198 of the rotating drum 12 and rotate the rotating drum 12 in the direction of arrow 14 (FIG. 1). The linking mechanism generally shown at 230 has a shaft supporting member 232 fixed to the rear surface of the vertical rear base plate 118 of the upper supporting frame 104, and a turning shaft 236 is rotatably mounted on the shaft supporting member 232 through bearing members 234 (two in the illustrated embodiment). To one end portion of the turning shaft 236 is fixed a drivingly linking member 242 formed as a unit with a gear portion 238 and a sprocket portion 240. The sprocket portion 240 of the drivingly linking member 242 is drivingly connected to a driving source such as an electric motor constituting a main driving source for the electrostatic copying apparatus through a transmission means such as a chain, although this is not shown in the drawings. Furthermore, the gear portion 238 of the linking member 242 is drivingly connected to constituent elements of the electrostatic copying apparatus through a suitable gear train. On the other hand, a key groove is formed in the other end portion of the turning shaft 236, and a linking gear 246 is mounted on the shaft 236 through a key member 244 fitted in the key groove. Accordingly, the linking gear 246 is mounted slidably in the axial direction of the turning shaft 236 but is adapted for rotation with the shaft 236. A stopping piece 248 is mounted on the other end of the turning shaft 236 to hamper the movement of the linking gear 246 and the key member 244 in the left direction in FIG. 7. A compression coil spring 250 for elastically biasing the linking gear 246 to the left in FIG. 7 is mounted between the linking gear 246 and the vertical rear base plate 118 of the upper supporting frame 104.

Let us suppose that the unit 132 is placed on the provisional unit placing means, the upper supporting frame 104 is pivoted from the open position to the closed position, and thereafter the unit 132 is moved rearwardly from the provisional unit placing position and held at the mounting position described above. If at this time the teeth of the gear portion 198 of the rotating drum 12 are in alignment with the teeth of the linking gear 246 in the above linking mechanism, the gear portion 198 comes into mesh with the linking gear 246, thereby drivingly connecting the linking member 242 to the rotating drum 12 through the turning shaft 236, the linking gear 246 and the gear portion 198. On the other hand, if the teeth of the gear portion 198 are not in alignment with the teeth of the linking gear 246, the teeth of the gear portion 198 abut against the teeth of the linking gear 246, and consequently the linking gear 246 is brought to a position shown by a two-dot chain line 246A in FIG. 7 against the elastic biasing action of the compression coil spring 250 (since the copying apparatus itself is inactive in this state, no inconvenience is caused). When the driving source (not shown) is operated in this state (for example when a power is applied to the copying apparatus), the linking gear 246 is turned and its teeth come into alignment with the teeth of the gear portion 198. As a result, the linking gear 246 is moved to the left in the drawing by the elastic biasing action of the compression coil spring 250 and the linking gear 246 comes into mesh with the gear portion 198. Thus, the linking member 242 is drivingly connected to the rotating drum 12, as shown in the drawing.

By interposing the linking mechanism 230 between the rotating drum 12 of the electrostatic copying apparatus and the driving source for rotating the rotating drum 12, meshing of the linking gear 246 with the gear portion 198 of the rotating drum 12 can be effected easily and accurately, and the unit 132 can be mounted very easily on the mounting position.

While the invention has been described hereinabove with reference to the specific embodiments, it should be understood that the invention is not limited to these specific embodiments, and various changes and modifications are possible without departing from the scope of the invention.

What is claimed is:

1. A shell-type electrostatic copying apparatus comprising a lower supporting frame, an upper supporting frame mounted for free pivotal movement about a pivot axis extending in the front-rear direction of said apparatus between an open position and a closed position, said upper supporting frame having a vertical front base plate and a vertical rear base plate spaced from each other in said front-rear direction, and a unit detachably mounted on the upper supporting frame, said unit including a unit frame having a front wall and a rear wall spaced from each other in said front-rear direction and a rotating drum rotatably mounted on the unit frame;

a provisional unit placing means provided on the lower supporting frame for supporting the unit frame of said unit for free movement over a predetermined range in said front-rear direction;

one of the front wall of the unit frame and the vertical front base plate of the upper supporting frame having formed therein at least two laterally spaced engaging openings, and the other of the front wall of the unit frame and the vertical front base plate of the upper supporting frame having formed therein at least two laterally spaced engaging projections, and one of the rear wall of the unit frame and the vertical rear base plate of the upper supporting frame having formed therein at least two laterally spaced engaging projections and the other of the rear wall of the unit frame and the vertical rear base plate of the upper supporting frame having formed therein at least two laterally spaced engaging openings, and a restraining means for releasably restraining the movement of the unit frame in said front-rear direction with respect to the upper supporting frame, when the unit frame is placed at a first predetermined position on the provisional unit placing means and the upper supporting frame is pivoted from the open position to the closed position, the engaging openings formed in said one of the front wall of the unit frame and the vertical front base plate of the upper supporting frame are brought into alignment in said front-rear direction with the engaging projections formed in said other of the front wall of the unit frame and the vertical front base plate of the upper supporting frame and the engaging projections formed in said one of the rear wall of the unit frame and the vertical rear base plate of the upper supporting frame are brought into alignment in said front-rear direction with the engaging openings formed in said other of the rear wall of the unit frame and the vertical rear base plate of the upper supporting frame, when the unit frame is moved rearwardly or frontwardly from said first predetermined position to a mounting position, the engaging openings formed in said one of the front wall of the unit frame and the vertical front base plate of the upper supporting frame are engaged with the engaging projections formed in said other on the front wall of the unit frame and the vertical front base plate of the upper supporting frame and the engaging projections formed in said one of the rear wall of the unit frame and the vertical rear base plate of the upper supporting frame are engaged with the engaging openings formed in said other of the rear wall of the unit frame and the vertical rear base plate of the upper supporting frame, when thereafter the movement of the unit frame in said front-rear direction with respect to the upper supporting frame is releasably restrained by the restraining means, the unit is detachably mounted on the upper supporting frame.

2. The apparatus of claim 1 wherein the unit includes a developing device mounted on the unit frame.

3. The apparatus of claim 1 wherein the lower supporting frame has a vertical front base plate and a vertical rear base plate spaced from each other in said front-rear direction.

4. The apparatus of claim 3 wherein the provisional unit placing means is comprised of at least two supporting pins implanted at laterally spaced positions in the rear surface of the vertical front base plate and at least two supporting pins implanted at spaced intervals in the front surface of the vertical rear base plate of the lower supporting frame, and the front wall and the rear wall of the unit are placed on the supporting pins.

5. The apparatus of claim 3 wherein at said first predetermined position on the provisional unit placing means, at least a part of the front surface of the front wall of the unit frame or at least a part of the rear surface of the rear wall of the unit frame abuts against the rear surface of the vertical front base plate of the lower supporting frame or the front surface of the vertical rear base plate of the lower supporting frame.

6. The apparatus of claim 3 wherein when the unit is to be placed on the provisional placing means, at least a part of the front surface of the front wall of the unit frame or at least a part of the rear surface of the rear wall of the unit frame abuts against the rear surface of the vertical front base plate of the lower supporting frame or the front surface of the vertical rear base plate to restrain one side of the unit frame, and at least one engaging projection formed in one of the rear wall of the unit frame and the vertical rear base plate of the upper supporting frame or in one of the front wall of the unit frame and the vertical front base plate of the upper supporting frame abuts against the front surface of the vertical rear base plate of the upper supporting frame or the rear surface of the vertical front base plate to restrict the other side of the unit frame.

7. The apparatus of claim 1 wherein at the mounting position, at least a part of the rear surface of the rear wall of the unit frame or at least a part of the front surface of the front wall abuts against the front surface of the vertical rear base plate of the upper supporting frame or the rear surface of the vertical front base plate of the upper supporting frame.

8. The apparatus of claim 1 wherein a groove is formed in that projecting portion which projects through at least one of the engaging openings, and the restraining means is constructed of a restraining member adapted to be releasably anchored in said groove to restrain the movement of the engaging projection with respect to the engaging projections in said front-rear direction.

* * * * *